US005636419A

United States Patent [19]

Foye

[11] Patent Number: 5,636,419

[45] Date of Patent: Jun. 10, 1997

[54] ONE PIECE PUFFING ASSEMBLIES FOR BURIAL CASKET CAP DISH ASSEMBLIES

[75] Inventor: Christopher W. Foye, Oldenburg, Ind.

[73] Assignee: Batesville Casket Company, Inc., Batesville, Ind.

[21] Appl. No.: 563,258

[22] Filed: Nov. 27, 1995

[51] Int. Cl.[6] ..... A61G 17/00

[52] U.S. Cl. ..... 27/19; 27/4; 229/186

[58] Field of Search ..... 27/4, 14, 19, 15, 27/16; 229/186

[56] References Cited

U.S. PATENT DOCUMENTS 2,664,615 1/1954 Hillenbrand et al. .

*Primary Examiner*—Kien T. Nguyen

*Attorney, Agent, or Firm*—Wood, Herron & Evans, L.L.P.

[57] ABSTRACT

One piece puffing assembly, mounted around the periphery and within the underside of a casket cap, includes two shorter sides, two longer sides, four miter corners, and peripherally inboard and outboard circumferential edges which define parallel planes, each of the sides being stepped in cross-section and having a first plurality of planar surfaces oriented perpendicular to the parallel planes, a second plurality of planar surfaces oriented at an angle of from 0–90 degrees relative to the parallel planes and being interposed between respective ones of the first planar planes.

24 Claims, 3 Drawing Sheets

ONE PIECE PUFFING ASSEMBLIES FOR BURIAL CASKET CAP DISH ASSEMBLIES

FIELD OF THE INVENTION

This invention relates generally to burial caskets, and more particularly to dish assemblies for burial casket caps and methods of continuously forming one piece puffing assemblies for the dish assemblies.

BACKGROUND OF THE INVENTION

Burial caskets traditionally comprise a shell to which is pivoted a cap or lid. During viewing of the deceased in the casket, the cap is of course pivoted to its open position to permit relatives, loved ones, acquaintances and the like to view the deceased. During this time the underside of the casket cap is visible. It is thus desirable to trim the underside of the cap with decorative trim. This has been traditionally accomplished with the installation of a dish assembly into the underside of the cap.

The traditional dish assembly has taken the form of a rectangular cap panel having two long sides and two short sides, with a puffing member being attached to each of the four sides. The cap panel is positioned in the casket cap atop a standoff, itself positioned in the cap, or atop a ridge or groove forming a part of the cap. The free edges of the puffing members are retained in a peripheral groove in the casket cap near the peripheral edge of the cap. The puffing members are so sized as to require them to assume a convex shape for their free edges to be retained in the peripheral groove. A rectangular cap panel insert, including decorative embroidery or the like, is installed between the four puffing members and in juxtaposition relative to the cap panel. Various means may be provided to secure the cap panel insert into the dish assembly.

Conventionally the puffing members have been attached to the cap panel with staples. Often the puffing members are as well stapled to each other at the corners. The process of stapling the four separate puffing members to the cap panel and to each other is tedious and time consuming. Further, should the casket be one destined for cremation, the use of staples is not desirable in the construction of the casket as great pains are taken to minimize, or totally eliminate, metal as a cremation casket construction material in view of the noncombustibility of metal.

As mentioned above, traditional puffings are all, for the most part, convex in shape. It would be desirable to offer to casket customers differently shaped puffings other than simply convex puffings, for example puffings including a series of stepped planar sections, to produce a "picture frame" look or the like.

It is therefore a main objective of the present invention to eliminate the four separate puffing members in the construction of the dish assembly.

It is another objective of the present invention to eliminate the need for staples to secure the puffing members to the cap panel and to each other in the construction of the dish assembly.

It is a further objective of the present invention to provide differently shaped puffings other than just convex puffings, for example picture frame type puffings or the like.

SUMMARY OF THE INVENTION

The present invention attains the stated objectives by providing a method of continuously forming one piece puffing assemblies each of which is adapted to be mounted around the periphery and within the underside of a casket cap, by providing a blank from which to fold a one piece puffing assembly, by providing a puffing assembly, and by providing a casket including a cap pivoted thereto having a puffing assembly mounted around the periphery and within the underside of said casket cap.

The method comprises the steps of providing a roll of sheet material from which to fabricate the puffing assemblies; forming a plurality of die cuts and score lines in the sheet material to enable successive lengths of the sheet material to be folded into one piece puffing assemblies each having two shorter sides, two longer sides and four miter corners; cutting the sheet material to length to form successive blanks from which to fold the one piece puffing assemblies; and folding the blanks into one piece puffing assemblies each having two shorter sides, two longer sides and four miter corners.

The method may further include the step of applying a decorative surface design to the sheet material, prior to the step of forming die cuts and score lines in the sheet material, so that when the puffing assembly is installed into the underside of the casket cap the decorative design is visible. The step of applying a decorative surface design to the sheet material is preferably accomplished by laminating a substrate having a decorative surface design to the sheet material.

The method may still further include the step of prefolding the sheet material along the score lines prior to the step of cutting the sheet material to length to form successive blanks.

The blank comprises an elongated sheet of material divided into two shorter sides and two longer sides intermediate the two shorter sides, adjacent ones of the sides being separated by miter corner forming structure. The miter corner forming structure comprises a score line transverse to the length of the elongated sheet of material; a series of stepped score lines on one side of the transverse score line and oriented at 45 degrees relative to the length of the elongated sheet of material; and a series of die cuts parallel the length of the elongated sheet of material commencing at the ends of the stepped 45 degree score lines, extending to the transverse score line and an equal distance on the other side of the transverse score line.

The blank may further include a series of score lines parallel the length of the elongated sheet of material connecting the ends of the die cuts, a tab foldably connected to a peripherally outboard edge of each of the shorter and longer sides along a score line for insertion into a groove in the periphery of the underside of the casket cap, and a tab foldably connected to a peripherally inboard edge of each of the shorter and longer sides along a score line for supporting thereatop a cap panel. The blank may still further include a score line intermediate a peripherally inboard edge of each peripherally inboard edge tab and the score line connecting that tab to each of the shorter and longer sides and defining a narrower tab portion and a wider tab portion, with the narrower tab portion being foldable peripherally outwardly and said wider tab portion being foldable peripherally inwardly. The blank may yet further include a die cut extending transversely of the elongated sheet of material from a peripherally outboard edge of the sheet to the peripherally outboardmost one of the series of die cuts parallel the length of the sheet.

The puffing assembly comprises two shorter sides, two longer sides, four miter corners and peripherally inboard and outboard circumferential edges, the peripherally inboard and outboard circumferential edges defining substantially parallel planes. The sides are stepped in cross-section having a first plurality of planar surfaces oriented perpendicular to the parallel planes and a second plurality of planar surfaces oriented at an angle of from 0 degrees to 90 degrees relative to the parallel planes and being interposed between respective ones of the first plurality of planar surfaces. The second plurality of planar surfaces are preferably parallel to the parallel planes.

The puffing assembly may further include a peripherally inwardly directed lip projecting from the peripherally inboard circumferential edge for supporting the peripheral edges of a cap panel inserted into the puffing assembly. In this connection the peripherally inwardly directed lip may include a first peripherally outwardly directed portion and a second peripherally inwardly directed portion.

Each puffing assembly miter corner is formed by folding the sheet along the transverse score line and the stepped score lines. The die cuts form rectangular tabs when the sheet is so folded. The miter corner is further formed by folding the rectangular tabs against one of the sides and securing the tabs to that side. The sheet is also folded along the score lines parallel the length of the elongated sheet of material such that said sides are stepped in cross-section having the above-described first plurality of planar surfaces and second plurality of planar surfaces.

A casket including a cap pivoted thereto and having the above-described puffing mounted around the periphery and within the underside of the casket cap is also provided.

One advantage of the present invention is that the four separate puffing members in the construction of the traditional dish assembly are eliminated.

Another advantage of the present invention is that the need for staples to secure the puffing members to the cap panel and to each other in the construction of the traditional dish assembly is eliminated.

A further advantage of the present invention is that differently shaped puffings other than just convex puffings, for example picture frame type puffings or the like, are provided.

These and other objects and advantages of the present invention will become more readily apparent during the following detailed description taken in conjunction with the drawings herein, in which:

DETAILED DESCRIPTION OF THE INVENTION

Figure 1:
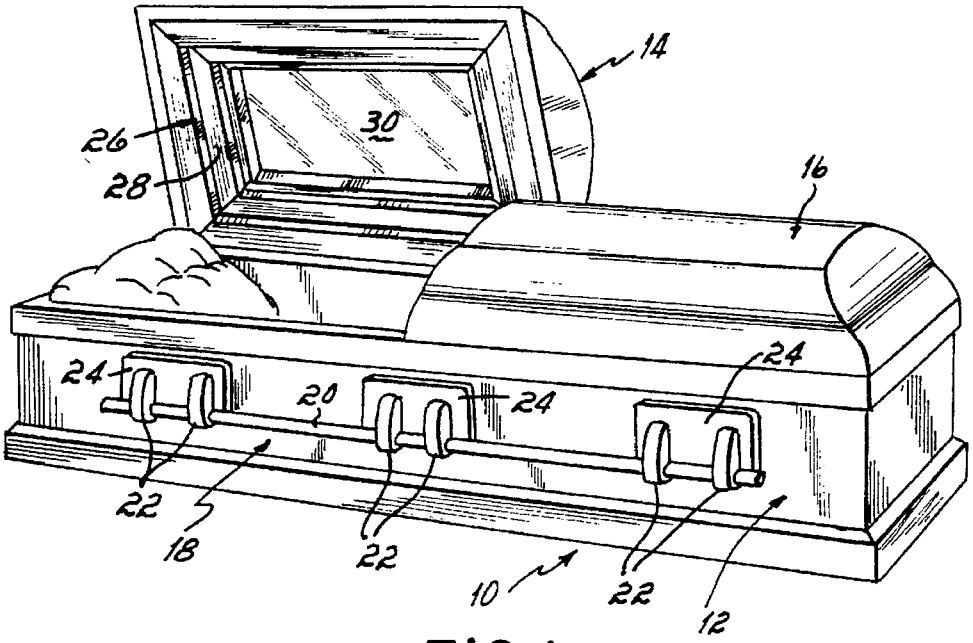
FIG. 1 is a perspective view of a casket including a puffing assembly according to the present invention.

Referring first to FIG. 1, there is illustrated a casket 10 according to the principles of the present invention. The casket 10 includes a shell 12 including head end 14 and foot end 16 caps pivoted thereto. Handling structure 18 takes the form of an elongated handle bar 20 connected through arms 22 to ears or escutcheon plates 24 themselves attached to the shell 12 with fasteners (not shown). A dish assembly 26 is mounted within the underside of cap 14 and includes a peripheral puffing assembly 28 and a cap panel 30 centrally of the puffing assembly 28. A removable decorative cap panel insert (not shown) may be removably installed centrally of the puffing assembly 28 and in juxtaposition to the cap panel 30.

Figure 2:
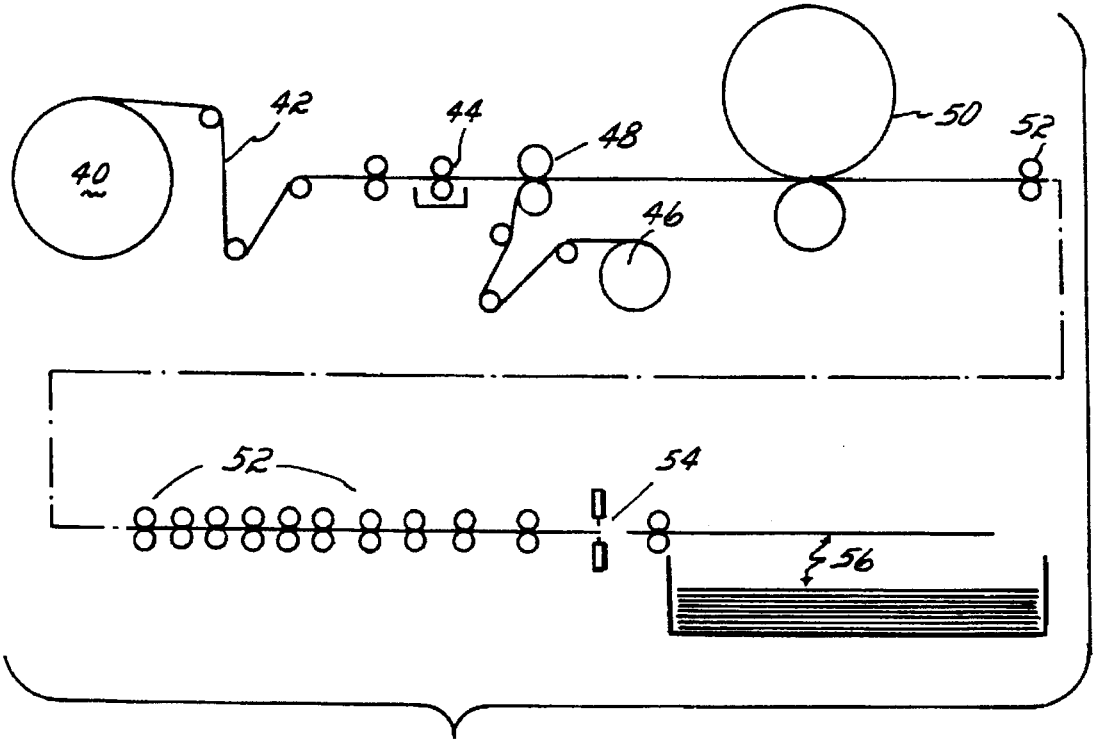
FIG. 2 is a side elevational view of apparatus for carrying out the method of the present invention.

Referring now to FIG. 2, there is illustrated apparatus for carrying out the method of the present invention of forming one piece puffing assemblies 28 each of which is adapted to be mounted around the periphery and within the underside of the casket cap 14. A roll 40 of sheet material, for example chipboard, advances a sheet 42 of the material through lamination glue rollers 44 for applying a film of glue onto the sheet 42. A roll of lamination substrate material 46 includes a decorative surface design or the like thereon and is laminated onto the glue-laden sheet 42 via lamination rollers 48. A continuous diecutting/scoring roller 50 forms a plurality of die cuts and score lines in the sheet 42 to enable successive lengths of the sheet 42 to be folded into one piece puffing assemblies 28 each having two shorter sides, two longer sides and four miter corners as will be more particularly described hereafter. A plurality of pre-folding rollers 52 pre-break or pre-fold the sheet 42 along the score lines to facilitate subsequent folding of individual puffing assemblies 28. A cutter 54 cuts to length the sheet 42 to form successive blanks 56 from which to fold the puffing assemblies 28.

Figure 3:
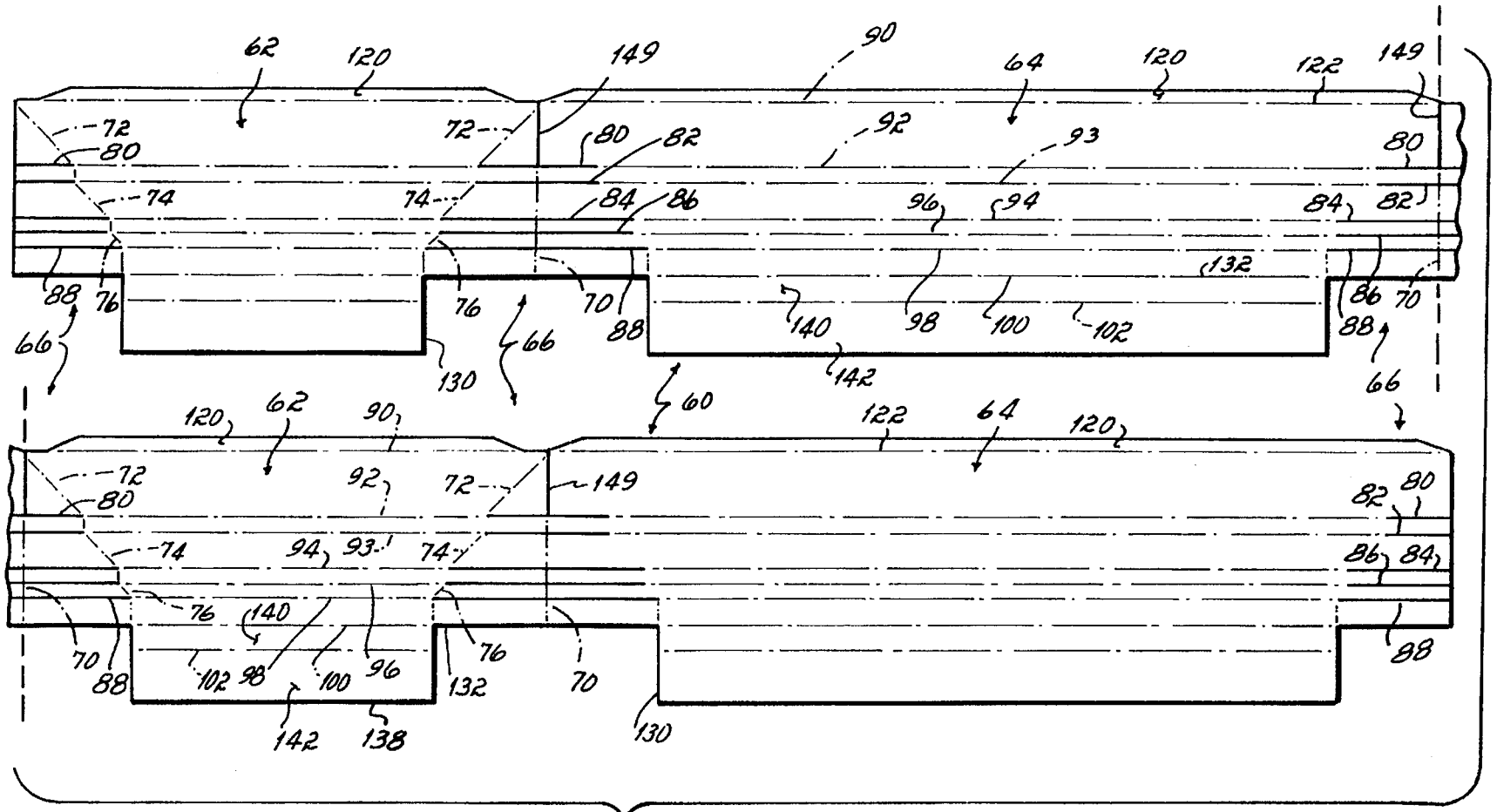
FIG. 3 is a top plan view of a blank from which to construct a puffing assembly according to the present invention.

Referring now to FIG. 3 there is illustrated a blank 56 manufactured according to the method of FIG. 1. The blank 56 is itself an elongated sheet 60 of material divided into two shorter sides 62, 62 and two longer sides 64, 64 intermediate the two shorter sides. Adjacent ones of the sides are separated or joined by miter corner forming structure 66.

A score line 70 extends transversely to the length of the elongated sheet 60. A series of stepped score lines 72, 74, 76 on one side of the transverse score line 70 are oriented at 45 degrees relative to the length of the elongated sheet 60. A series of die cuts 80, 82, 84, 86 and 88 parallel the length of the elongated sheet 60 commence at the ends of the stepped 45 degree score lines 72, 74, 76 respectively, extend to the transverse score line 70 and an equal distance on the other side of the transverse score line 70.

A plurality of score lines 92, 93, 94, 96, 98 parallel the length of the sheet 60 and connect the ends of the die cuts 80, 82, 84, 86 and 88 respectively. Score lines 90, 100 and 102 are also provided for a purpose to be subsequently described. Tabs 120 are foldably connected to a peripherally outboard edge 122 of each of the shorter and longer sides 62, 64 along the score line 90. The tabs 120 are for insertion into a groove (not shown) in the periphery of the underside of the casket cap as is conventional.

The blank 56 further includes a tab 130 foldably connected to a peripherally inboard edge 132 of each of the shorter and longer sides 62, 64 along the score line 100 for supporting thereatop the cap panel 30, as will be subsequently described. Preferably the additional score line 102 is located intermediate the peripherally inboard edge 138 of each tab 130 and the score line 100 defining a narrower tab portion 140 and a wider tap portion 142, as will be subsequently described in more detail.

The blank 56 further includes a die cut 149 extending transversely of the sheet 60 from the peripherally outboard edge 122 of the sheet 60 to the peripherally outboardmost one 80 of the series of die cuts parallel the length of the sheet 60 for a purpose to be described.

Figure 4:
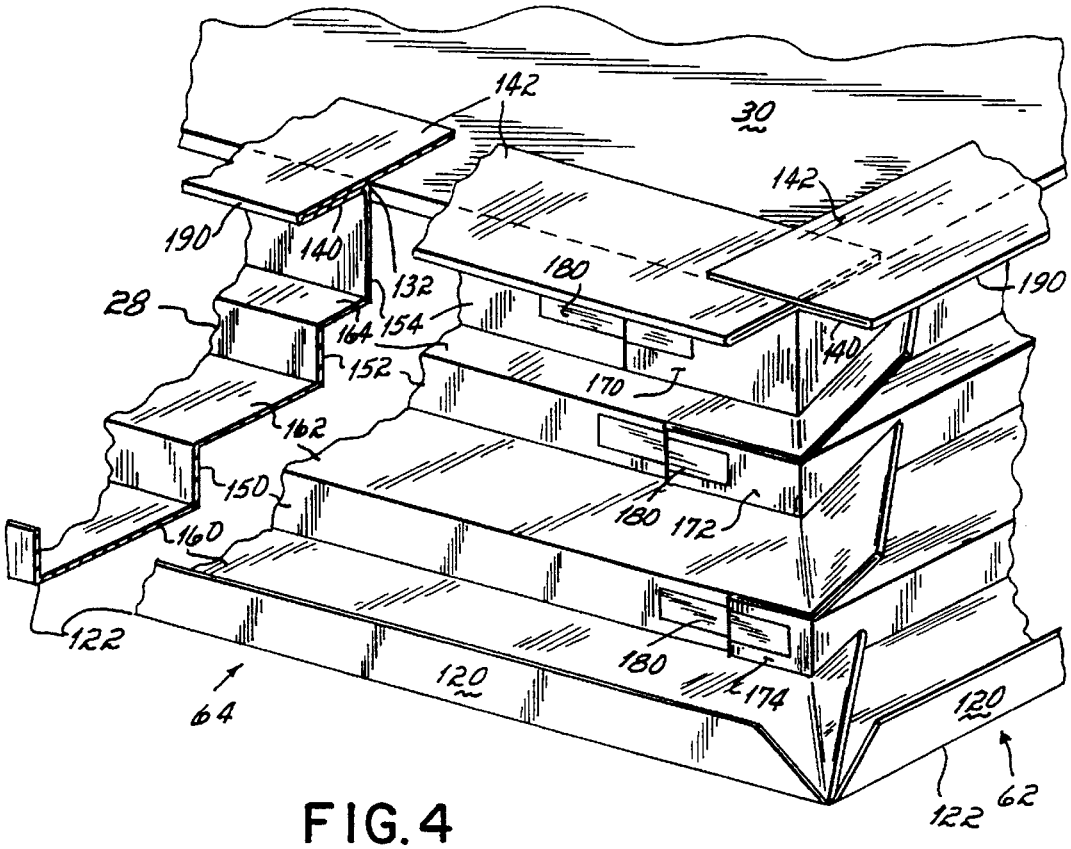
FIG. 4 is a partial perspective view, partially broken away, and from the underneath side, of one corner of the puffing assembly of the present invention.

Referring now to FIG. 4, a corner of the erected puffing assembly 28 is illustrated. As is illustrated, the sides 62 and 64 of the puffing assembly 28 are stepped in cross-section presenting a "picture frame" appearance, having three planar surfaces 150, 152 and 154 oriented perpendicular to essentially parallel planes defined by the peripherally inboard 132 and peripherally outboard 122 circumferential edges, and having three planar surfaces 160, 162 and 164 oriented parallel to those planes. Of course the angles of the surfaces 160, 162 and 164 could be oriented at any angle of essentially from 0 degrees to 90 degrees with respect to those planes, depending on the overall heights of the puffing assembly 28 desired.

Figure 5:
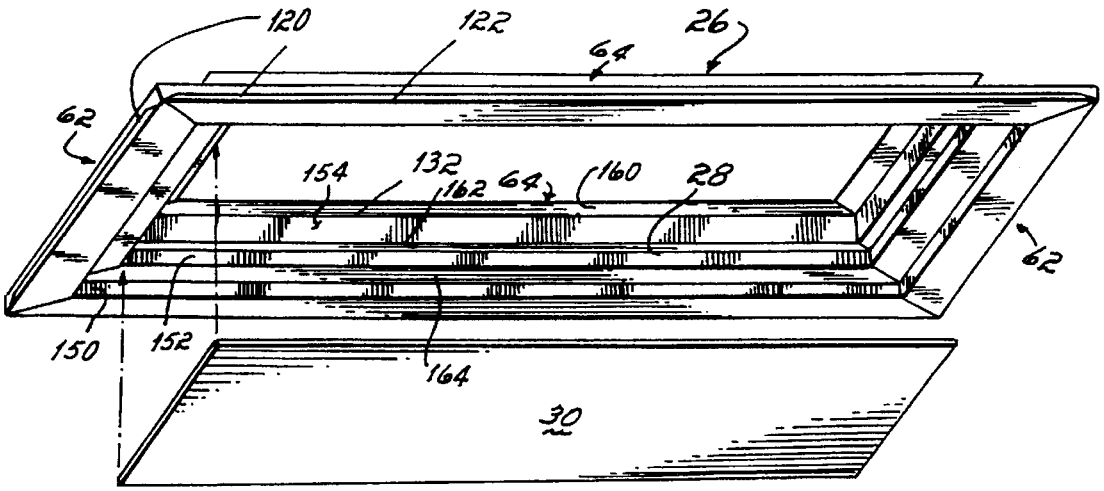
FIG. 5 is a perspective view of the puffing assembly of FIG. 4.

To produce the miter corners, the sheet 60 is folded along score line 70, and then along score lines 72, 74 and 76. The die cuts 80, 82, 84, 86 and 88 form a series of rectangular tabs 170, 174, 176 when the sheet 60 is so folded and the tabs are themselves folded against either of the longer or shorter sides 62, 64 and secured there with, for example, tape 180. Tab portion 140 is folded peripherally outwardly and tab portion 142 is folded peripherally inwardly, and cap panel 30 is supported on tab portion 142 when installed into the puffing assembly 28 (FIG. 5). Doubled over portion 190 of the tab portions 140, 142 may be supported within the cap 14 as by the dish support disclosed in co-pending patent application Ser. No. 08/458,133, filed Jun. 2, 1995, entitled Dish Support For Burial Casket, assigned to the assignee of the present invention and hereby incorporated by reference herein as if fully set forth in its entirety. The die cuts 149 enable each of the sides and ends 62, 64 to be easily manipulated and individually installed into the groove in the casket cap 14.

The puffing assembly of the present invention is usable in both wooden caskets as well as sheet metal caskets. Should it be desired to install the dish assembly 28 of the present invention in the cap of a sheet metal casket, it is preferable for the tabs 120 to include an additional tab (not shown) foldably connected thereto to aid in insertion of the puffing assembly into the plastic "gimp" mounted around the periphery of the underside of the sheet metal casket cap.

Those skilled in the art will readily recognize numerous adaptations and modifications which can be made to the present invention which will result in an improved dish assembly for a burial casket cap, yet all of which will fall within the spirit and scope of the present invention as defined in the following claims. Accordingly, the invention is to be limited only by the scope of the following claims and their equivalents.

What is claimed is:

1. A blank from which to fold a one piece puffing assembly adapted to be mounted around the periphery and within the underside of a casket cap comprising:

an elongated sheet of material divided into two shorter sides and two longer sides intermediate said two shorter sides, adjacent ones of said sides being separated by miter corner forming structure;

said miter corner forming structure comprising:

a score line transverse to the length of said elongated sheet of material;

a series of stepped score lines on one side of said transverse score line and oriented at 45 degrees relative to the length of said elongated sheet of material; and a series of die cuts parallel the length of said elongated sheet of material commencing at the ends of said stepped 45 degree score lines, extending to said transverse score line and an equal distance on the other side of said transverse score line.

2. The blank of claim 1 further including a series of score lines parallel the length of said elongated sheet of material connecting the ends of said die cuts.

3. The blank of claim 2 further including a tab foldably connected to a peripherally outboard edge of each of said shorter and longer sides along a score line for insertion into a groove in the periphery of the underside of the casket cap.

4. The blank of claim 2 further including a die cut extending transversely of said elongated sheet of material from a peripherally outboard edge of said sheet to the peripherally outboardmost one of said series of die cuts parallel the length of said sheet.

5. The blank of claim 1 further including a tab foldably connected to a peripherally inboard edge of each of said shorter and longer sides along a score line for supporting thereatop a cap panel.

6. The blank of claim 5 further including a score line intermediate a peripherally inboard edge of each said tab and said score line connecting said tab to each of said shorter and longer sides and defining a narrower tab portion and a wider tab portion, said narrower tab portion foldable peripherally outwardly and said wider tab portion foldable peripherally inwardly.

7. A puffing assembly adapted to be mounted around the periphery and within the underside of a casket cap comprising:

two shorter sides, two longer sides, four miter corners and peripherally inboard and outboard circumferential edges, said peripherally inboard and outboard circumferential edges defining substantially parallel planes;

said sides being stepped in cross-section having a first plurality of planar surfaces oriented perpendicular to said parallel planes and a second plurality of planar surfaces oriented at an angle of from 0 degrees to 90 degrees relative to said parallel planes and being interposed between respective ones of said first plurality of planar surfaces.

8. The puffing assembly of claim 7 wherein said second plurality of planar surfaces are parallel to said parallel planes.

9. The puffing assembly of claim 7 further including a peripherally inwardly directed lip projecting from said peripherally inboard circumferential edge for supporting the peripheral edges of a cap panel inserted into said puffing assembly.

10. The puffing assembly of claim 9 wherein said peripherally inwardly directed lip includes a first peripherally outwardly directed portion and a second peripherally inwardly directed portion.

11. A puffing assembly fabricated from an elongated sheet of material and adapted to be mounted around the periphery and within the underside of a casket cap comprising:

two shorter sides, two longer sides, four miter corners and peripherally inboard and outboard circumferential edges, said peripherally inboard and outboard circumferential edges defining substantially parallel planes;

each said miter corner formed from miter corner forming structure comprising:

a score line transverse to the length of said elongated sheet of material;

a series of stepped score lines on one side of said transverse score line and oriented at 45 degrees relative to the length of said elongated sheet of material; and a series of die cuts parallel the length of said elongated sheet of material commencing at the ends of said stepped 45 degree score lines, extending to said transverse score line and an equal distance on the other side of said transverse score line;

said miter corners formed by folding said sheet along said transverse score line and said stepped score lines, said die cuts forming rectangular tabs when said sheet is folded along said transverse and stepped score lines, said miter corners further formed by folding said rectangular tabs against one of said sides and securing said tabs to said one side.

12. The puffing assembly of claim 11 wherein said sheet further includes a series of score lines parallel the length of said elongated sheet of material connecting the ends of said die cuts, said sheet being folded along said score lines such that said sides are stepped in cross-section having a first plurality of planar surfaces oriented perpendicular to said parallel planes and a second plurality of planar surfaces oriented at an angle of from 0 degrees to 90 degrees relative to said parallel planes and being interposed between respective ones of said first plurality of planar surfaces.

13. The puffing assembly of claim 12 wherein said second plurality of planar surfaces are parallel to said parallel planes.

14. The puffing assembly of claim 11 further including a peripherally inwardly directed lip projecting from said peripherally inboard circumferential edge for supporting the peripheral edges of a cap panel inserted into said puffing assembly.

15. The puffing assembly of claim 14 wherein said peripherally inwardly directed lip includes a first peripherally outwardly directed portion and a second peripherally inwardly directed portion.

16. A casket including a cap pivoted thereto having a puffing assembly mounted around the periphery and within the underside of said casket cap, said puffing assembly comprising:

two shorter sides, two longer sides, four miter corners and peripherally inboard and outboard circumferential edges, said peripherally inboard and outboard circumferential edges defining substantially parallel planes;

said sides being stepped in cross-section having a first plurality of planar surfaces oriented perpendicular to said parallel planes and a second plurality of planar surfaces oriented at an angle of from 0 degrees to 90 degrees relative to said parallel planes and being interposed between respective ones of said first plurality of planar surfaces.

17. The casket of claim 16 wherein said second plurality of planar surfaces are parallel to said parallel planes.

18. The casket of claim 16 further including a peripherally inwardly directed lip projecting from said peripherally inboard circumferential edge for supporting the peripheral edges of a cap panel inserted into said puffing assembly.

19. The casket of claim 18 wherein said peripherally inwardly directed lip includes a first peripherally outwardly directed portion and a second peripherally inwardly directed portion.

20. A casket including a cap pivoted thereto having a puffing assembly fabricated from an elongated sheet of material and mounted around the periphery and within the underside of said casket cap, said puffing assembly comprising:

two shorter sides, two longer sides, four miter corners and peripherally inboard and outboard circumferential edges, said peripherally inboard and outboard circumferential edges defining substantially parallel planes;

each said miter corner formed from miter corner forming structure comprising:

a score line transverse to the length of said elongated sheet of material;

a series of stepped score lines on one side of said transverse score line and oriented at 45 degrees relative to the length of said elongated sheet of material; and a series of die cuts parallel the length of said elongated sheet of material commencing at the ends of said stepped 45 degree score lines, extending to said transverse score line and an equal distance on the other side of said transverse score line;

said miter corners formed by folding said sheet along said transverse score line and said stepped score lines, said die cuts forming rectangular tabs when said sheet is folded along said transverse and stepped score lines, said miter corners further formed by folding said rectangular tabs against one of said sides and securing said tabs to said one side.

21. The casket of claim 20 wherein said sheet further includes a series of score lines parallel the length of said elongated sheet of material connecting the ends of said die cuts, said sheet being folded along said score lines such that said sides are stepped in cross-section having a first plurality of planar surfaces oriented perpendicular to said parallel planes and a second plurality of planar surfaces oriented at an angle of from 0 degrees to 90 degrees relative to said parallel planes and being interposed between respective ones of said first plurality of planar surfaces.

22. The casket of claim 21 wherein said second plurality of planar surfaces are parallel to said parallel planes.

23. The casket of claim 20 further including a peripherally inwardly directed lip projecting from said peripherally inboard circumferential edge for supporting the peripheral edges of a cap panel inserted into said puffing assembly.

24. The casket of claim 23 wherein said peripherally inwardly directed lip includes a first peripherally outwardly directed portion and a second peripherally inwardly directed portion.

* * * * *